US011466513B2

(12) United States Patent
Büdenbender et al.

(10) Patent No.: US 11,466,513 B2
(45) Date of Patent: Oct. 11, 2022

(54) FRAME COMPRISING PROFILE CONNECTORS WITH A ROTATIONAL JOINT

(71) Applicant: Arnd Büdenbender, Netphen-Deuz (DE)

(72) Inventors: Arnd Büdenbender, Netphen-Deuz (DE); Ritske Johannes Van Leeuwen, Koedijk (NL)

(73) Assignee: Arnd Büdenbender, Netphen-Deuz (DE)

( * ) Notice: Subject to any disclaimer, the term of this patent is extended or adjusted under 35 U.S.C. 154(b) by 0 days.

(21) Appl. No.: 17/293,473

(22) PCT Filed: Jan. 20, 2020

(86) PCT No.: PCT/EP2020/051213
§ 371 (c)(1),
(2) Date: May 12, 2021

(87) PCT Pub. No.: WO2020/152069
PCT Pub. Date: Jul. 30, 2020

(65) Prior Publication Data

US 2022/0018186 A1 Jan. 20, 2022

(30) Foreign Application Priority Data

Jan. 21, 2019 (EP) ..... 19152738

(51) Int. Cl.
*E06B 9/52* (2006.01)
*E06B 9/24* (2006.01)
(Continued)

(52) U.S. Cl.
CPC ..... *E06B 9/522* (2013.01); *E06B 1/045* (2013.01); *E06B 9/06* (2013.01); *E06B 9/24* (2013.01); *E06B 9/52* (2013.01); *E06B 2009/527* (2013.01)

(58) Field of Classification Search
CPC ..... E06B 1/045; E06B 1/56; E06B 2009/002; E06B 2009/527; E06B 9/06
(Continued)

(56) References Cited

U.S. PATENT DOCUMENTS 1,065,402 A * 6/1913 Stearns ..... D06C 3/00 160/230
1,325,961 A * 12/1919 Smith ..... E06B 9/06 55/496
(Continued)

FOREIGN PATENT DOCUMENTS

DE 202015009191 U1 * 12/2016 ..... E06B 9/522
EP 1788186 A2 5/2007
(Continued)

OTHER PUBLICATIONS

"International Search Report for PCT Patent Application No. PCT/EP2020/051213", dated Apr. 24, 2020, 3 Pages.
(Continued)

*Primary Examiner* — Brent W Herring
(74) *Attorney, Agent, or Firm* — Calfee, Halter & Griswold LLP

(57) ABSTRACT

The present invention relates to a frame for an insect protection device for use with a building opening, comprising
at least two vertical frame struts (1.1, 1.2),
at least two horizontal frame struts (2.1, 2.2), and
profile connectors (5.1, 5.2, 6.1, 6.2) in each case comprising at least one first connecting arm (7) and one second connecting arm (8), characterised in that
(Continued)

Figure 1:
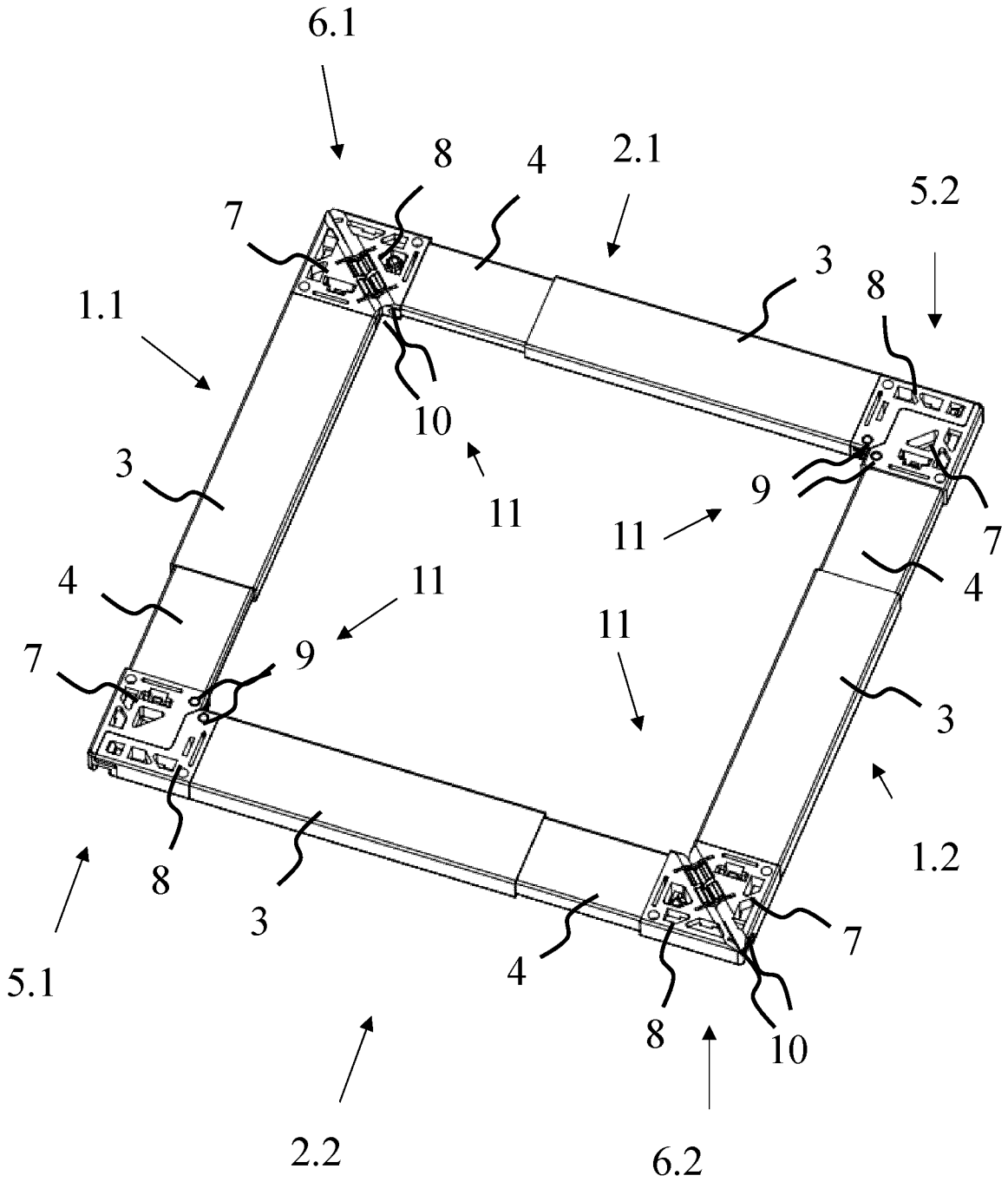

each profile connector (5.1, 5.2, 6.1, 6.2) has a rotational joint (11) between the connecting arms (7, 8) having at least one axis of rotation (9, 10), such that in an initial position the vertical frame struts (1.1, 1.2) and the horizontal frame struts (2.1, 2.2) are oriented parallel to one another and that, by pivoting the frame struts (1.1, 1.2, 2.1, 2.2) relative to one another about the axes of rotation (9, 10) of the rotational joints (11) of the profile connectors (5.1, 5.2, 6.1, 6.2) connecting together two respective frame struts, the frame is able to be transferred into an assembly position in which the horizontal frame struts (2.1, 2.2) and the vertical frame struts (1.1, 1.2) are arranged in a frame plane at a right angle to one another.

15 Claims, 5 Drawing Sheets

(51) Int. Cl.
*E06B 1/04* (2006.01)
*E06B 9/06* (2006.01)

(58) Field of Classification Search
USPC ..... 160/372, 374, 377
See application file for complete search history.

(56) References Cited

U.S. PATENT DOCUMENTS

| | | | | | |
|---|---|---|---|---|---|
| 1,782,415 | A * | 11/1930 | Farmer | E06B 9/01 | 160/374 |
| 1,952,055 | A * | 3/1934 | Burcham | E06B 9/01 | 160/374 |
| 5,431,211 | A * | 7/1995 | Guillemet | E06B 9/52 | 403/231 |
| 5,450,701 | A * | 9/1995 | White | E06B 9/52 | 160/381 |
| 5,483,779 | A * | 1/1996 | Crawford | G09F 15/00 | 52/645 |
| 5,797,218 | A * | 8/1998 | Holland | E06B 9/04 | 49/55 |
| 7,422,048 | B2 * | 9/2008 | Andersen | E06B 9/00 | 49/55 |
| 8,184,213 | B2 * | 5/2012 | Yuzawa | G03B 21/58 | 348/838 |
| 11,174,675 | B1 * | 11/2021 | Flannery | E05B 65/0007 | |
| 2006/0180283 | A1 | 8/2006 | Andersen | | |
| 2012/0186755 | A1 * | 7/2012 | Sessa | E06B 9/54 | 160/239 |
| 2012/0211182 | A1 * | 8/2012 | Pilgrim | E06B 9/06 | 160/375 |
| 2015/0330142 | A1 * | 11/2015 | Pilgrim | E05D 3/02 | 160/374 |
| 2021/0180393 | A1 * | 6/2021 | Torosian | E06B 11/04 | |

FOREIGN PATENT DOCUMENTS

| | | | | |
|---|---|---|---|---|
| EP | 2128374 | A2 * | 12/2009 | E06B 9/52 |
| EP | 2682558 | A2 | 1/2014 | |
| EP | 2878757 | A2 * | 6/2015 | E06B 9/52 |
| EP | 3138990 | B1 | 5/2018 | |
| EP | 3690177 | A1 * | 8/2020 | E06B 9/522 |
| WO | 2020152069 | A1 | 7/2020 | |
| WO | WO-2020152069 | A1 * | 7/2020 | E06B 9/24 |
| WO | WO-2021116137 | A1 * | 6/2021 | E06B 9/522 |

OTHER PUBLICATIONS

"Written Opinion of the International Searching Authority for PCT Patent Application No. PCT/EP2020/051213", dated Apr. 24, 2020, 5 Pages.

* cited by examiner

FRAME COMPRISING PROFILE CONNECTORS WITH A ROTATIONAL JOINT

The present invention relates to a frame for a protection device, such as an insect protection device or light shaft cover, for use with a building opening such as a window or door, comprising at least two vertical frame struts which in each case have at least one outer profile strip and at least one inner profile strip which is inserted in a telescopic manner into the outer profile strip to an insertion depth, at least two horizontal frame struts which in each case have at least one outer profile strip and at least one inner profile strip which is inserted in a telescopic manner into the outer profile strip to an insertion depth, and profile connectors in each case comprising at least one first connecting arm and one second connecting arm, wherein the first connecting arm is at least partially inserted into a profile strip of a vertical frame strut and the second connecting arm is at least partially inserted into a profile strip of a horizontal frame strut. Such a frame may be adapted in a simple manner to the size of a building opening due to the telescopability of the inner profile strips and the outer profile strips of the frame struts.

A frame having the aforementioned features is disclosed, for example, in EP 3 138 990 B1. The components of such a frame are generally provided to the end user as a construction kit, so that the end user firstly has to assemble the components before an insect protection net may be fixed to the frame. For this purpose, the end user has to introduce the profile connectors, in particular, into the respective profile strips of the frame struts, if required with the assistance of a tool. In order to reduce the assembly effort relative thereto, it is disclosed in DE 10 2015 116 588 A1, for example, to preassemble profile strip pairs of two frame struts via the corner connectors. However, in this case, a relatively large package is required since the profile strip pairs which are arranged at right angles to one another and which are connected together via a corner connector span a large surface area. Moreover, even with this solution the end user still has to insert the preassembled profile strips into the profile strips of other preassembled profile strip pairs.

It is the object of the present invention, therefore, to remedy the drawbacks set forth with reference to the prior art and, in particular, to specify a frame of a protection device which is more user-friendly and which may be assembled using less effort.

The object is achieved by a frame having the features of the independent claim. Advantageous developments of the frame are specified in the dependent claims and in the description, wherein individual features of the advantageous developments may be combined together in any technically expedient manner.

The object is achieved, in particular, by a frame having the features cited in the introduction, in which each profile connector has a rotational joint between the connecting arms having at least one axis of rotation, and which are configured such that, in an initial position of the frame, the vertical frame struts and the horizontal frame struts are oriented parallel to one another, and that, by pivoting the frame struts relative to one another about the axis of rotation of the rotational joints of the profile connectors connecting together two respective frame struts, the frame is able to be transferred into an assembly position in which the horizontal frame struts and the vertical frame struts are arranged in a frame plane at a right angle to one another.

The basic idea of the invention thus provides that the profile connectors are configured in the manner of hinges so that the frame struts which are preassembled via the profile connectors may be provided to the end user in a compact initial position. The end user then merely has to fold the frame from its initial position into the assembly position, wherein in the assembly position the frame is able to be adapted in a simple manner to different sizes of building opening, by telescoping the inner profile strips and the outer profile strips relative to one another. Subsequently, the end user then merely has to fix the frame, which is adapted to the building opening, at the corresponding insertion depth of the inner profile strip and the outer profile strip and attach the insect protection net to the frame.

It should be mentioned that the terms "horizontal" and "vertical" refer to an orientation of the frame in a vertical plane for use with a door or a window. In the case of the use of the frame with a light shaft cover, all of the frame struts are arranged in a substantially horizontal plane so that the frame struts which are denoted in the application as vertical frame struts are also arranged in the horizontal plane, but also at a right angle to the frame struts denoted as horizontal frame struts.

At least two frame struts which oppose one another and which are thus parallel in the assembly position, in each case have at least one outer profile strip and one inner profile strip which is telescopable relative to the outer profile strip. However, the frame struts, for example, may also have in each case two outer profile strips and one inner profile strip which is telescopable into both outer profile strips, or in each case two inner profile strips and one outer profile strip which is telescopable into both inner profile strips. The inner profile strip in each case is inserted into the outer profile strip to a length denoted as the insertion depth, wherein the insertion depth may be changed by the end user up to the final fixing of the insertion depth. For the telescopability, the inner contour of the outer profile strip, in particular, is complementary to the outer contour of the inner profile strip.

The connecting arms of the profile connectors have in each case, in particular, an insertion portion which is located in the profile strip and which is fixed non-positively and/or positively in the profile strip. Additionally, each connecting arm, in particular, has a corner portion which protrudes over the profile strip and thus is arranged outside the profile strip, in particular is configured in one piece with the insertion portion, the at least one axis of rotation of the rotational joint being configured thereon or therein. Each profile connector is thus configured in multiple parts and comprises at least the first connecting arm, the second connecting arm and optionally elements for forming the axis of rotation, which are configured as separate components.

It is provided, in particular, that a latching element is configured on the first connecting arm and a latching element which is complementary to the first latching element is configured on the second connecting arm so that the connecting arms are latched together in the assembly position. The latching element, for example, may have, in particular, a hook-shaped projection which engages behind a corresponding complementary undercut on the second connecting arm in the assembly position. In this manner, a first securing may be provided, the connecting arms being secured thereby in the assembly position against being inadvertently pivoted back.

So that the profile connectors in the assembly position provide the frame with a high degree of stability, it may be provided that the first connecting arm of a profile connector has a stabilising element which protrudes, in particular, from its corner portion in the initial position in the direction of the second connecting arm, and which in the assembly position overlaps the second connecting arm of the profile connector. The stabilising element which protrudes, in particular, in one piece on the profile connector is received, in particular, in a corresponding recess of the second connecting arm. In this case it may be provided, in particular, that at least one latching element is configured on the stabilising element.

Between two connecting arms of each profile connector the rotational joint has, in particular, just two axes of rotation, the one axis of rotation thereof being configured in or on the first connecting arm and the second axis of rotation thereof being configured in or on the second connecting arm. The axes of rotation of each rotational joint oriented parallel to one another are in this case connected together via at least one connecting element.

In one embodiment, the axes of rotation of the rotational joints of profile connectors diagonally opposing one another in the assembly position are oriented at right angles to the frame plane. Such a rectangular frame (portion) thus has four frame struts, two thereof being connected in each case to one profile connector, wherein the diagonally opposing profile connectors which are not connected to the same frame struts have an axis of rotation oriented at right angles to the frame plane spanned by the frame struts in the assembly position.

In this connection, it is provided that the other two profile connectors, which also in each case diagonally oppose one another, have axes of rotation which in the assembly position are oriented parallel to the frame plane or are arranged in the frame plane. The axes of rotation of these rotational joints are in this case oriented, in particular, at an angle of 45 degrees to the direction of extension of the frame struts connected to the profile connector.

With such an arrangement it is possible that in each case two pairs of frame struts, which are arranged parallel to one another in the initial position, are firstly able to be transferred into an intermediate position by pivoting about the axes of rotation of two profile connectors oriented at right angles to the frame plane, the two pairs of parallel frame struts being arranged at a right angle relative to one another in said intermediate position, wherein the frame struts are secondly able to be transferred from the intermediate position into the assembly position by pivoting two pairs of frame struts arranged at right angles to one another in the intermediate position about axes of rotation of two profile connectors arranged parallel to or in the frame plane.

In other words, therefore, the frame struts which are arranged parallel to one another in the initial position are firstly moved by a pivoting movement into a right-angled arrangement relative to one another, by the frame struts being pivoted about the axes of rotation arranged at right angles to the frame plane. Subsequently, the frame is then unfolded further by the frame struts being pivoted about the axes of rotation arranged in the frame plane, wherein the profile connectors already arranged at right angles to one another (and having the axes of rotation oriented at right angles to the frame plane), which were still arranged adjacent to one another in the intermediate position, are moved onto the diagonally opposing sides of the unfolded frame.

One of the profile connectors, which are already arranged in the intermediate position at right angles to one another, thus describes a type of circular arc movement from the intermediate position into the assembly position.

In an alternative embodiment of the frame, the axes of rotation of all of the rotational joints are oriented at right angles to the frame plane. In this case, in particular, the axes of rotation of diagonally opposing profile connectors are arranged outside on the profile connectors, whilst the axes of rotation of the further diagonally opposing profile connectors are arranged toward the inside of the frame. In this manner, during the folding process the frame struts of the frame are arranged in a rhombus-shape relative to one another (the vertical frame struts are arranged parallel to one another and the horizontal frame struts are arranged parallel to one another) such that the frame struts in the initial position are oriented parallel to one another.

In order to fix the profile connectors in their assembly position and to secure the profile connectors against being inadvertently pivoted back, it may be provided that in the assembly position one respective cover cap is able to be introduced into the profile connectors, said cover cap securing the connecting arms of the respective profile connector against pivoting. These cover caps are thus, in particular, of planar configuration and connected to two connecting arms of the profile connector. To this end, the cover caps may be fixed positively to the profile connector, for example by means of a latching connection. The cover cap may also be fastenable non-positively to the profile connector. Therefore, the respective profile connector is statically fixed by the cover cap and thus forms a stable unit.

In order that the insect protection device is able to be attached in a simple manner to a window frame, the profile connectors have one respective receiver for a suspension element which may be fixed, in particular, by means of a latching connection. It is possible for the suspension elements to able to be fixed non-positively and/or positively to the profile connector, in particular without the use of an additional tool. In particular, an L-shaped suspension element may be provided, said L-shaped suspension element having regular recesses on its arm which is able to be inserted into the receiver and which is able to be fixed non-positively and/or positively in the receiver to a resiliently deflectable hook element in inserted positions of varying depth. Such an L-shaped suspension element thus may be adapted in a simple manner to window frames of various depths.

Frames for insect protection devices generally have a sealing element, such as brush seals, on the side facing the building and on a portion oriented toward the frame exterior. So that such a seal is also implemented in the region of the corners and thus in the region of the profile connectors, in particular, the corner regions of the connecting arms of a profile connector may have one respective receiving groove for receiving sealing elements extending along the connecting arm. So that the sealing element may be inserted in a simple manner into the receiving groove even in the assembly position, it is provided that the receiving groove of the first connecting arm is open on its front face toward a frame exterior in the assembly position, and the receiving groove of the second connecting arm is closed on the front face by the first connecting arm in the assembly position. Thus, in each case the sealing element may only be inserted into the frame strut from one side, into the respective frame strut via the receiving groove which is open toward the frame exterior, whilst on the opposing side the insertion of a sealing element is defined by the receiving groove which is closed by means of the second connecting arm.

It is possible to provide different means by which the inner profile strip and the outer profile strip of a frame strut are able to be fixed to one another to an insertion depth which is predetermined by the size of the building opening, wherein a separate solution is seen in these means, in combination with a frame described in the introduction, independently of the above-described solution and in particular independently of the profile connectors comprising the rotational joints:

- for example an adhesive strip extending over the entire length of a frame strut may be provided, a plurality of T-shaped latching hooks (more than 10 or more than 100) being configured on the upper face thereof remote from the adhesive side for fixing an insect protection net. The adhesive strip thus has a dual function. It serves for the mutual fixing of the inner profile strip and the outer profile strip to an insertion depth and for the attachment of the insect protection net. The T-shaped latching hooks are arranged with the stem thereof oriented at right angles to the upper face of the adhesive strip, in particular in a plurality of rows oriented in parallel to one another. On the horizontal bar of the T-shape which is configured, in particular, parallel to the direction of extent of the frame strut, small hooks are configured at the ends. In this regard the insect protection net may be fastened in the manner of a hook/loop fastener to the adhesive strip.
- the insertion depth may also be fixed by means of a double-sided adhesive strip extending over the entire length of the frame strut, wherein a fastening profile strip is fastened by the double-sided adhesive strip to the frame strut. The fastening profile strip has, in particular, two portions which extend along the frame strut, which are movable relative to one another about a pivot axis running parallel to the frame strut, and which may be folded up together. The two portions are, in particular, of one-piece configuration, wherein the pivot axis is implemented by a relatively thin material thickness between the portions. For fixing in the folded-up state both elements have, in particular, positive connection elements extending along the frame strut, in the folded-up state an insect protection net being fixed therebetween. In this case, in particular, it may be provided that a further double-sided adhesive tape is provided inside the fastening profile strip, the insect protection net being able to be initially prepositioned thereby, wherein the primary fixing of the insect protection net is carried out by the positive connection elements.
- additionally an adapter profile strip which may be attached to the inner profile strip and which is positioned and/or inserted on a projection extending along the inner profile strip or into a groove extending along the inner profile strip may be provided, wherein an outer profile and/or an inner profile of the adapter profile strip is aligned with a corresponding profile of a projection and/or a groove of the outer profile strip. Thus a clamping strip extending over the entire frame strut may be positioned onto the adapter profile strip (in the region of the inner profile strip) and onto the projection (in the region of the outer profile strip). Alternatively a weatherstrip-like clamping strip may be inserted in the region of the outer profile strip into the groove of the outer profile strip and in the region of the inner profile strip into a groove predetermined by the adapter profile strip. An insect protection net may be clamped between the clamping strip and the projection/groove of the outer profile strip and the adapter profile strip, in the region of the inner profile strip.
- additionally a strip which is adhesively bonded to a portion of the inner profile strip (for example double-sided adhesive tape, metal or plastic strip) may be provided, said strip firstly defining the insertion depth into the adjacent outer profile strip and secondly with its upper face being flush with an adjacent surface of the outer profile strip, so that a further element (for example the above-mentioned fastening profile strip) is able to be attached in one plane over the entire length of the frame strut. The strip thus has a thickness which substantially corresponds to the wall thickness of the outer profile strip.

The frame may be used not only for spanning a two-dimensional insect protection net but also as a frame for a pleated insect protection net. To this end, at least the inner profile strip and the outer profile strip of the vertical frame struts have an opening which is continuous along the direction of extent thereof and which faces a frame interior for receiving a pleated fabric. Thus an edge of the pleated fabric may be arranged inside the vertical frame struts, wherein the pleated fabric extends as far as the opposing vertical frame strut and into said frame strut.

In one embodiment, the frame is provided for use as an insect protection device for a window, in which case the frame consists, in particular, of two lateral vertical frame struts and a lower and an upper horizontal frame strut, wherein the profile connectors are configured as corner connectors with in each case just two connecting arms which are pivotable relative to one another. Such a frame may be fastened to a window frame by means of the suspension elements already described above.

The proposed frame, however, may also be provided for a door opening, in which case the frame is able to be fastened, for example, by means of hinges to a door frame. In this case, the frame consists, in particular, of four lateral frame struts and a lower, a central and an upper horizontal frame strut, wherein the central frame strut is connected in each case at both ends to two vertical frame struts by means of a profile connector which is configured as a central connector, wherein the central connector has in each case three connecting arms which are pivotable relative to one another.

Also proposed is an insect protection device which comprises a frame according to the invention and an insect protection net which in the case of a pleated fabric is movably fastened on or in the frame.

Figure 2:
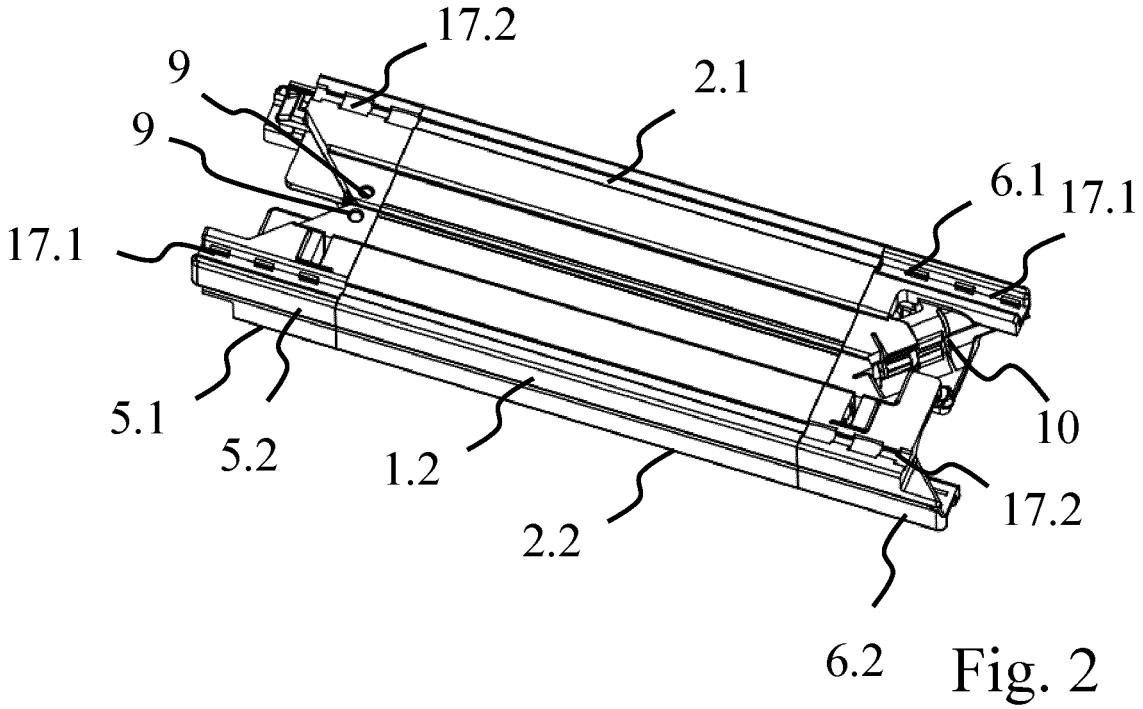
Figure 3:
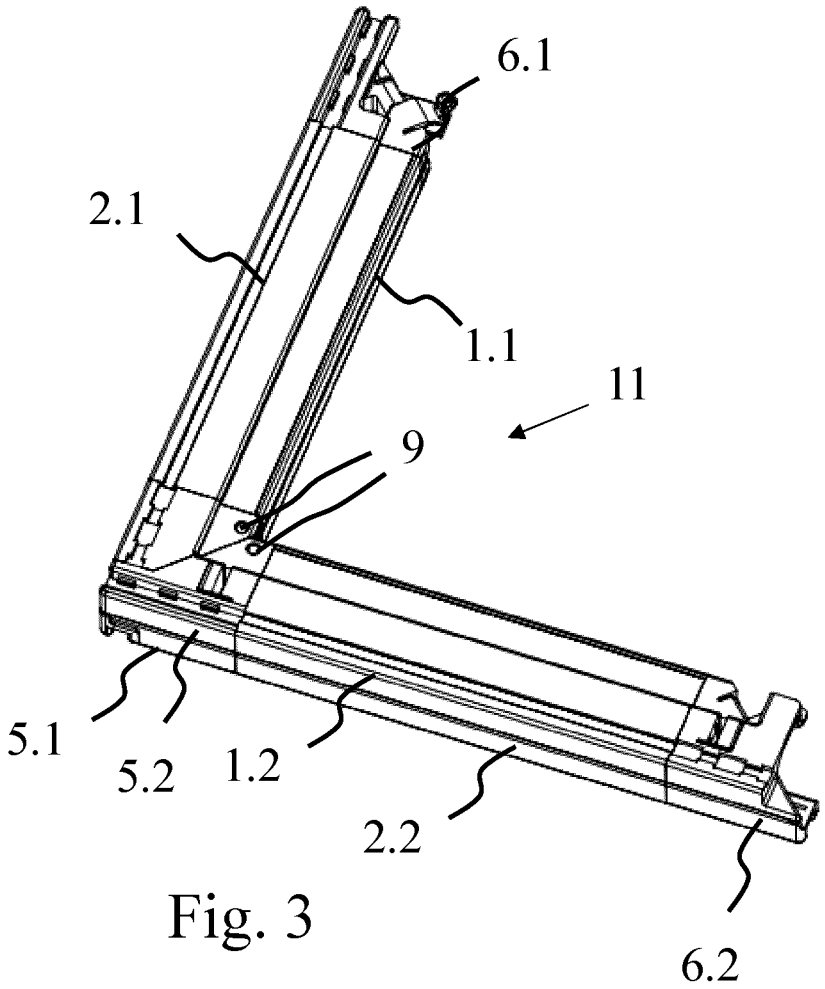
Figure 4:
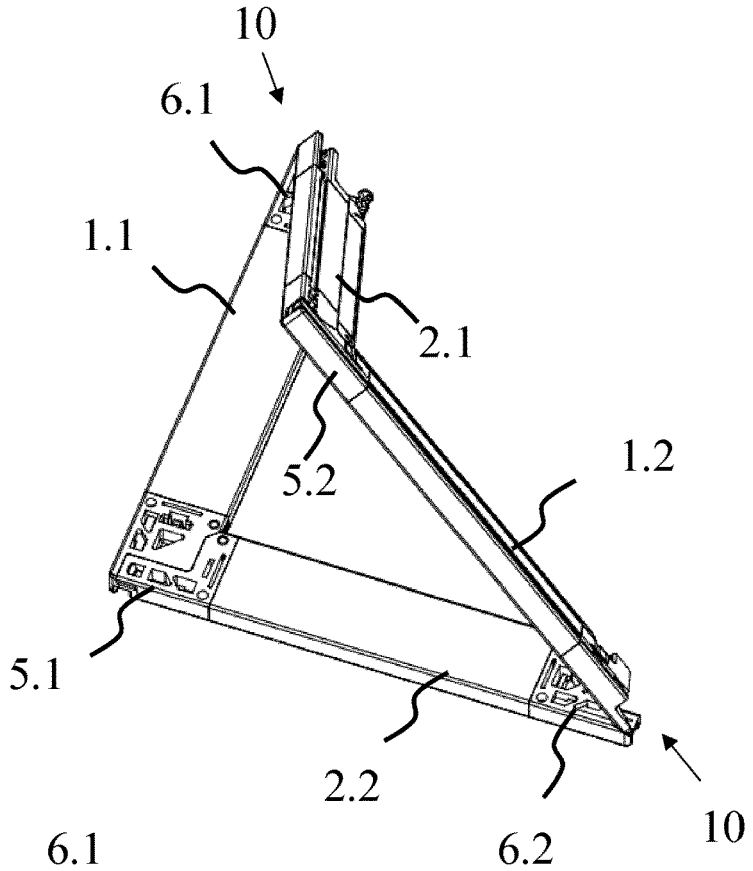
Figure 5:
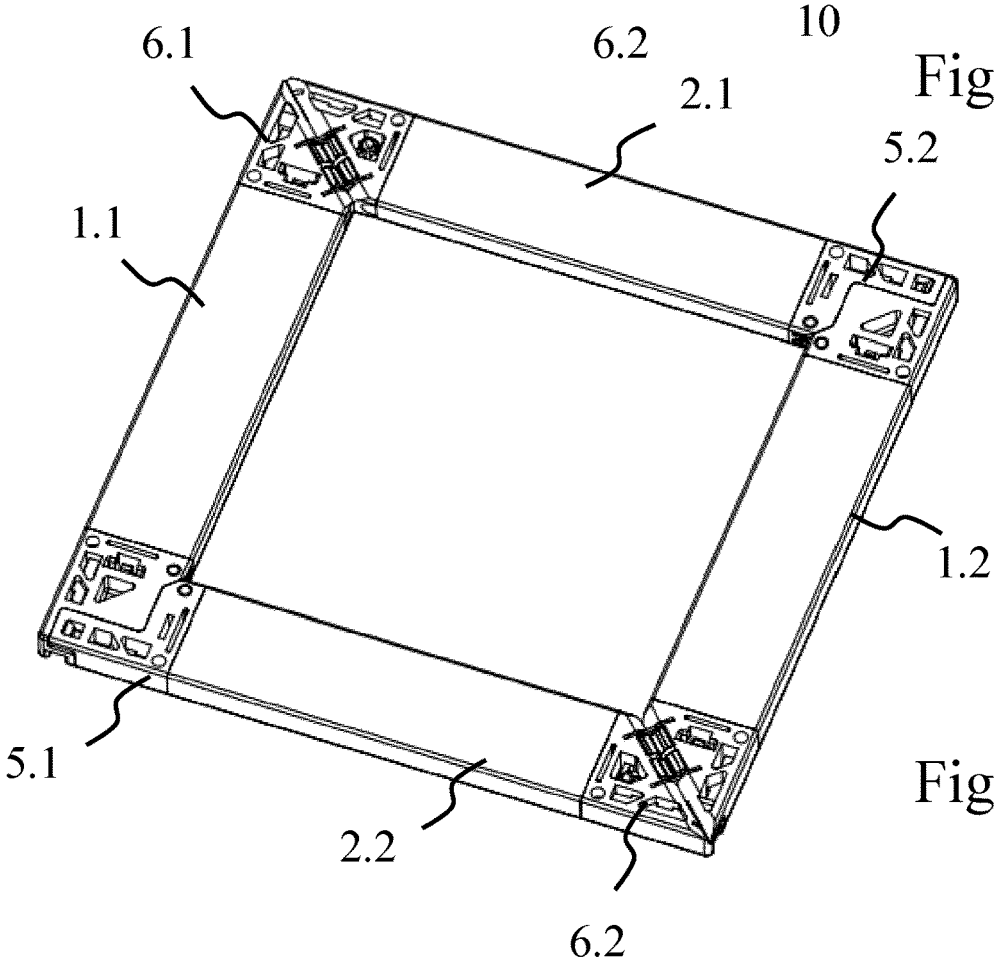
Figure 6:
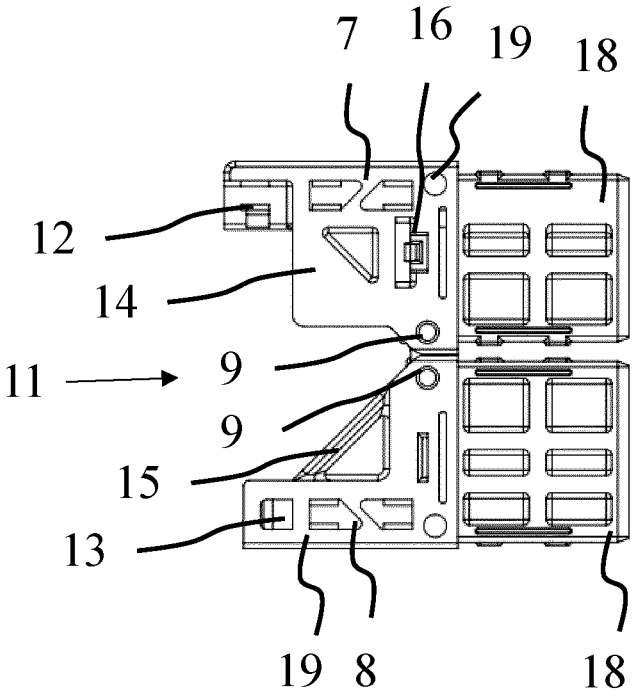
Figure 7:
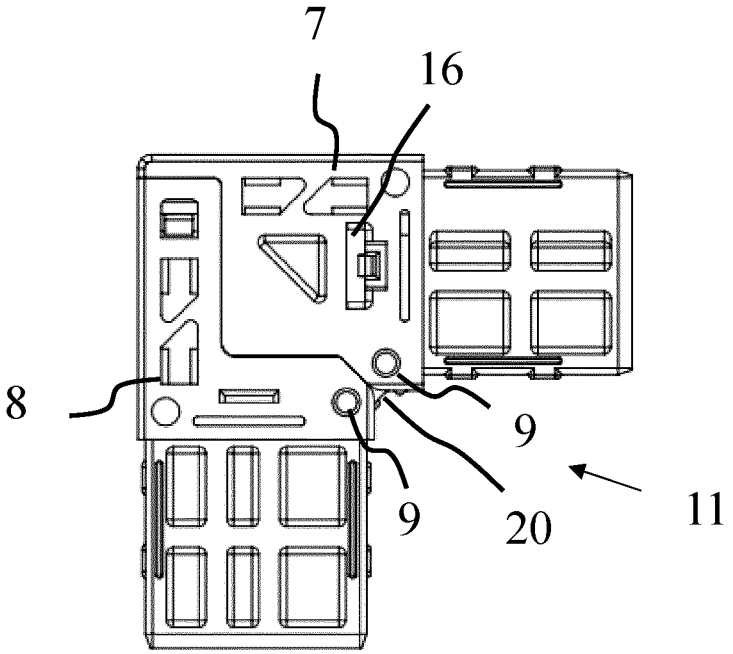
Figure 8:
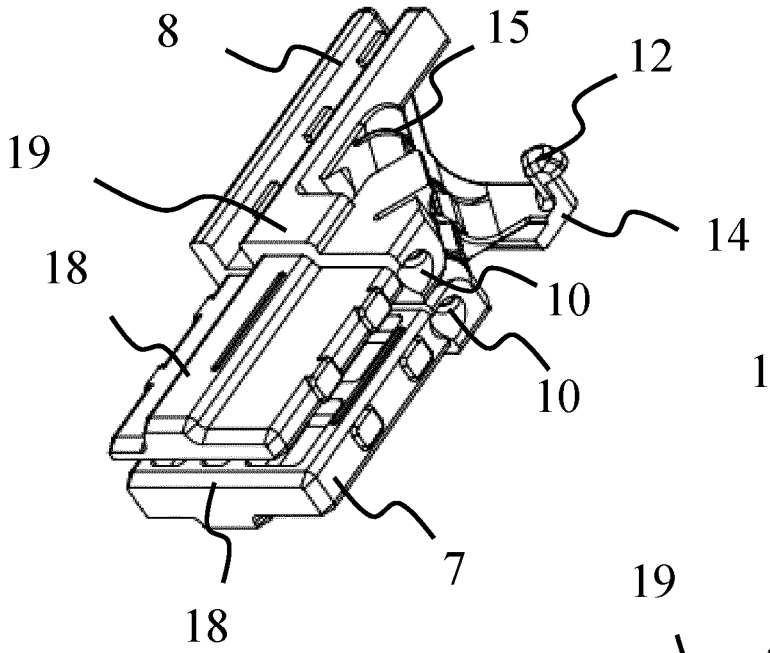
Figure 9:
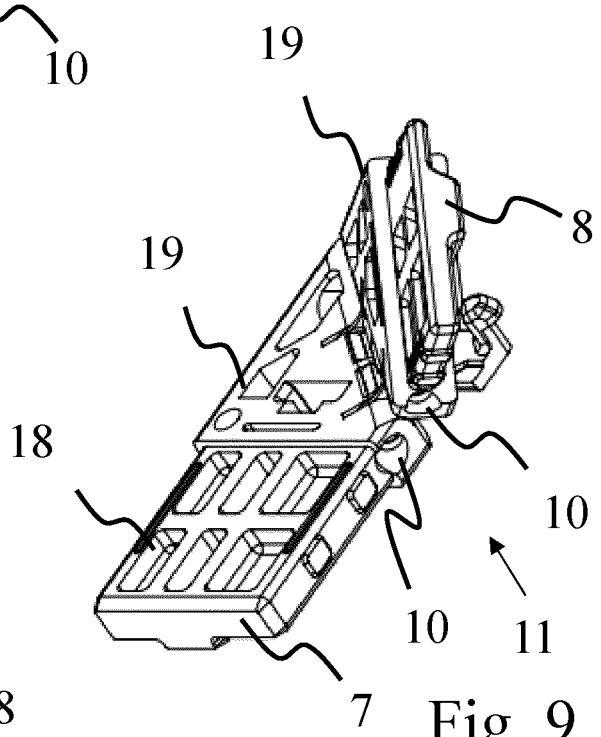
Figure 10:
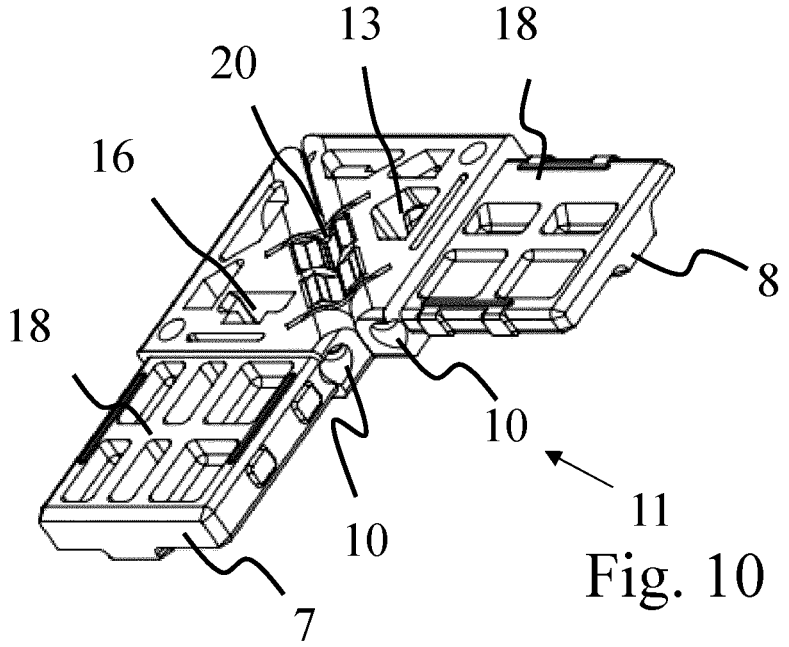

The invention and the technical background are described by way of example hereinafter with reference to the figures, in which schematically:

FIG. 1: shows a frame in the assembly position and with the profile strips partially extended, FIG. 2: shows the frame in an initial position, FIG. 3: shows the frame in an intermediate position, FIG. 4: shows the frame when transferred from the intermediate position into an assembly position, FIG. 5: shows the frame in the assembly position, FIG. 6: shows a profile connector with axes of rotation oriented at right angles to the frame plane in the initial position, FIG. 7: shows the profile connector according to FIG. 6 in the assembly position, FIG. 8: shows a profile connector with axes of rotation oriented parallel to the frame plane in the initial position, FIG. 9: shows the profile connector according to FIG. 8 when transferred from the intermediate position into the assembly position and FIG. 10: shows the profile connector according to FIG. 8 in the assembly position.

The frame shown in FIGS. 1 to 5 comprises a first vertical frame strut 1.1 and a second vertical frame strut 1.2 as well as a first horizontal frame strut 2.1 and a second horizontal frame strut 2.2 The frame shown in perspective in FIGS. 1 and 5 in its assembly position spans a frame plane.

The frame struts 1.1, 1.2, 2.1 and 2.2 in each case consist of an outer profile strip 3 and an inner profile strip 4. The inner profile strips 4 and the outer profile strips 3 in each case are telescopable relative to one another so that the size of the frame (length of the frame struts) may be adapted in a simple manner to various sizes of window, wherein an insect protection net, not shown, may be fastened to the frame which is fixed to a size.

The outer profile strip 3 of the first vertical frame strut 1.1 is connected to the inner profile strip 4 of the first horizontal frame strut 2.1 via a first profile connector 6.1 with axes of rotation 10 oriented parallel to the frame plane, wherein a first connecting arm 7 of the profile connector 6.1 is inserted into the outer profile strip 3 of the first vertical frame strut 1.1 and a second connecting arm 8 of the first profile connector 6.1 is inserted into the inner profile strip 4 of the first horizontal frame strut 2.1. A second profile connector 6.2, with a joint 11 having two axes of rotation 10 oriented parallel to the frame plane, connects the inner profile strip 4 of the second horizontal frame strut 2.2 to the outer profile strip 3 of the second vertical frame strut 1.2.

A first profile connector 5.1 with a rotational joint 11 having two axes of rotation 9 arranged at right angles to the frame plane connects the inner profile strip 4 of the first vertical frame strut 1.1 to the outer profile strip 3 of the second horizontal frame strut 2.2, by means of its first connecting arm 7 and its second connecting arm 8. A second profile connector 5.2, with a rotational joint 11 also having two axes of rotation 9 arranged at right angles to the frame plane, additionally connects the outer profile strip 3 of the first horizontal frame strut 2.1 to the inner profile strip 4 of the second vertical frame strut 1.2.

A profile connector with axes of rotation 9 arranged at right angles to the frame plane, is shown in FIGS. 6 and 7 in detail as inserted as a first profile connector 5.1 and a second profile connector 5.2. The profile connector comprises a first connecting arm 7 and a second connecting arm 8. The connecting arms 7 and 8 in each case have an insertion portion 18 which is inserted into a profile strip of the frame strut. The connecting arms 7 and 8 additionally have in each case a corner portion 19 which protrudes over the profile strips. An axis of rotation 9 is configured in each case on the corner portions 19, said axes of rotation being oriented at right angles to the frame plane and being connected together via a connecting element 20.

Additionally a hook-shaped latching element 12 and a stabilising element 14 are configured on the first connecting arm 7 of the profile connector shown in FIG. 6, whilst a complementary latching element 13 in the form of an undercut and a complementary stabilising element 15 in the form of a recess are configured on the second connecting arm 8.

In the initial position shown in FIG. 6 the insertion portions 18 of the first connecting arm 7 and of the second connecting arm 8 are oriented parallel to one another. By pivoting the first connecting arm 7 and the second connecting arm 8 about the joint 11 which is configured with the two axes of rotation 9 at right angles, the profile connector may be transferred into the position shown in FIG. 7 in which the insertion portions 18 and thus the connecting arms 7 and 8 are arranged at a right angle to one another. In this position, the hook-shaped latching element 12 engages in the complementary latching element 13 configured by an undercut, whilst the stabilising element 14 of the first connecting arm 7 which is configured as a projection engages in the complementary stabilising element 15 which is configured as a recess. Thus the profile connector firstly is secured against being inadvertently pivoted back by means of the latching element 12 and the complementary latching element 13, and secondly is oriented in a stable manner by means of the stabilising element 14 and the complementary stabilising element 15.

The profile connector shown in FIGS. 8 to 10 also has a first connecting arm 7 and a second connecting arm 8 with in each case an insertion portion 18 and a corner portion 19. The first connecting arm 7 and the second connecting arm 8 are connected together via a rotational joint 11, wherein an axis of rotation 10 oriented parallel to the frame plane is configured in the first connecting arm 7 and a second axis of rotation 10 oriented parallel to the frame plane is configured in the second connecting arm 8.

The axes of rotation 10 are connected together via a connecting element 20. Additionally a stabilising element 14 with a hook-shaped latching element 12 configured thereon is configured on the first connecting arm 7, whilst a complementary stabilising element in the form of a recess and a complementary latching element 13 in the form of an undercut are configured on the second connecting arm 8.

In the initial position shown in FIG. 8 the insertion portions 18 of the connecting arms 7 and 8 are oriented parallel to one another. The connecting arms 7 and 8 may be moved by pivoting about the two axes of rotation 10 (see FIG. 9) into the position shown in FIG. 10, in which the insertion portions 18 and thus also the connecting arms 7 and 8 are arranged at a right angle to one another. In the position shown in FIG. 10 the hook-shaped latching element 12 engages behind the undercut as a complementary latching element 13, so that this profile connector is also secured against being inadvertently pivoted back. Additionally the stabilising element 14 of the first connecting arm 7 overlaps the complementary stabilising element 15 of the second connecting arm 8, so that a high degree of stability is provided in the position shown in FIG. 10.

From FIGS. 6 to 10, it may also be identified that the respective first connecting arm 7 has a receiver 16, a suspension element (not shown) being able to be inserted therein, wherein, due to the resilient configurations of a latching hook, the suspension element may be fixed in a simple manner on the profile connector at different insertion positions so that a simple adaptation is possible of the suspension element to the depth of a window frame to which the frame is intended to be fastened.

It is thus possible to arrange the frame struts 1.1, 1.2, 2.1 and 2.2 parallel to one another in the initial position shown in FIG. 2, whilst each profile connector 5.1, 5.2, 6.1 and 6.2 with its two connecting arms 7, 8 in each case is already inserted into a profile strip of two frame struts. Thus, the frame may be shipped preassembled in a very compact state.

In order to unfold the frame from the initial position into an assembly position, therefore, firstly the first vertical frame strut 1.1 and the first horizontal frame strut 2.1 are pivoted together with the second vertical frame strut 1.2 and the second horizontal frame strut 2.2 about the axes of rotation 9 of the profile connectors 5.1 and 5.2 oriented at right angles to the frame plane, into the intermediate position shown in FIG. 3. In the intermediate position shown in FIG. 3, the pair of frame struts consisting of the first vertical frame strut 1.1 and the first horizontal frame strut 2.1 is arranged at a right angle to the pair of frame struts consisting of the second vertical frame strut 1.2 and the second horizontal frame strut 2.2, wherein the profile connectors 5.1 and 5.2 are in the state shown in FIG. 7.

Subsequently (see FIG. 4), therefore, the second vertical frame strut 1.2 together with the first horizontal frame strut 2.1 are then pivoted relative to the first vertical frame strut 1.1 and the second horizontal frame strut 2.2 about the axes of rotation 10 of the profile connectors 6.1 and 6.2 arranged parallel to the frame plane, until all of the frame struts 1.1, 1.2, 2.1 and 2.2 are arranged in one plane in which the vertical frame struts 1.1 and 1.2 are arranged parallel to one another and at a right angle to the horizontal frame struts 2.1 and 2.2. This position, which is also denoted as the assembly position, is shown in FIG. 5.

From the assembly position shown in FIG. 5, the frame may be adapted to the size of a window frame by simply being pulled apart, wherein the outer profile strips 3 and the inner profile strips 4 are telescoped relative to one another.

It is possible by means of the present invention to provide the end user with a preassembled frame in a compact manner, wherein the end user subsequently only has to unfold the frame. An adaptation of the size may thus be carried out in a simple manner due to the telescopable profile strips.

From FIG. 2 it may further be identified that the corner portions 19 of the connecting arms 7 and 8 in each case have a receiving groove 17.1 and/or 17.2, wherein the first receiving groove 17.1 is accessible from a frame exterior even in the assembly position, so that sealing elements are able to be directly inserted into the first receiving groove 17.1 and subsequently may be inserted into corresponding grooves in the profile strips. The second receiving grooves 17.2, however, are closed on the front face by the other connecting arm in the assembly position, so that during an insertion process a definitive end stop is predetermined.

LIST OF REFERENCE NUMERALS

1.1, 1.2 Vertical frame strut
2.1, 2.2 Horizontal frame strut
3 Outer profile strip
4 Inner profile strip
5.1, 5.2 Profile connector with right-angled axis of rotation
6.1, 6.2 Profile connector with parallel axis of rotation
7 First connecting arm
8 Second connecting arm
9 Right-angled axis of rotation
10 Parallel axis of rotation
11 Rotational joint
12 Latching element
13 Complementary latching element
14 Stabilising element
15 Complementary stabilising element
16 Receiver
17.1, 17.2 Receiving groove
18 Insertion portion
19 Corner portion
20 Connecting element

The invention claimed is:

1. A frame for a protection device for use with a building opening, comprising at least two vertical frame struts (1.1, 1.2) which in each case have at least one outer profile strip (3) and at least one inner profile strip (4) which is inserted in a telescopic manner into the outer profile strip(s) (3) to an insertion depth, at least two horizontal frame struts (2.1, 2.2) which in each case have at least one outer profile strip (3) and at least one inner profile strip (4) which is inserted in a telescopic manner into the outer profile strip (s) (3) to an insertion depth, and profile connectors (5.1, 5.2, 6.1, 6.2) in each case comprising at least one first connecting arm (7) and one second connecting arm (8), wherein the first connecting arm (7) is at least partially inserted into a profile strip (3, 4) of a vertical frame strut (1.1, 1.2) and the second connecting arm (8) is at least partially inserted into a profile strip (3, 4) of a horizontal frame strut (2.1, 2.2), characterised in that each profile connector (5.1, 5.2, 6.1, 6.2) has a rotational joint (11) between the connecting arms (7, 8) having at least one axis of rotation (9, 10), such that in an initial position the vertical frame struts (1.1, 1.2) and the horizontal frame struts (2.1, 2.2) are oriented parallel to one another and that, by pivoting the frame struts (1.1, 1.2, 2.1, 2.2) relative to one another about the axes of rotation (9, 10) of the rotational joints (11) of the profile connectors (5.1, 5.2, 6.1, 6.2) connecting together two respective frame struts, the frame is able to be transferred into an assembly position in which the horizontal frame struts (2.1, 2.2) and the vertical frame struts (1.1, 1.2) are arranged in a frame plane at a right angle to one another.

2. Frame according to claim 1, wherein the connecting arms (7, 8) of at least one profile connector (5.1, 5.2, 6.1, 6.2) have latching elements (12, 13) which are complementary to one another and which latch together the connecting arms (7, 8) in the assembly position.

3. Frame according to claim 1, wherein the first connecting arm (7) of a profile connector (5.1, 5.2, 6.1, 6.2) has a protruding stabilising element (14) which in the assembly position overlaps the second connecting arm (8) of the profile connector (5.1, 5.2, 6.1, 6.2).

4. Frame according to claim 1, wherein one respective axis of rotation (9, 10) for the rotational joint (11) is configured on each connecting arm (7, 8) of a profile connector (5.1, 5.2, 6.1, 6.2).

5. Frame according to claim 1, wherein the axes of rotation (9) of the rotational joints (11) of profile connectors (5.1, 5.2) diagonally opposing one another in the assembly position are oriented at right angles to the frame plane.

6. Frame according to claim 5, wherein two respective pairs (1.1 and 2.1, 1.2 and 2.2) of parallel frame struts are firstly able to be transferred from the starting position into an intermediate position by pivoting about the axes of rotation (9) of at least two profile connectors (5.1, 5.2) oriented at right angles to the frame plane, the two pairs (1.1 and 1.2, 2.1 and 2.2) of parallel frame struts being arranged at a right angle relative to one another in said intermediate position, wherein the frame struts are secondly able to be transferred from the intermediate position into the assembly position by pivoting two pairs (1.1 and 2.2, 1.2 and 2.1) of frame struts arranged at right angles to one another in the intermediate position about axes of rotation (10) of two profile connectors (6.1, 6.2) arranged parallel to or in the frame plane.

7. Frame according to claim 1, wherein the axes of rotation (10) of the rotational joints (11) of profile connectors (6.1, 6.2) diagonally opposing one another in the assembly position are oriented parallel to the frame plane or are arranged in the frame plane.

8. Frame according to claim 1, wherein in the assembly position one respective cover cap is able to be introduced into the profile connectors (1.1, 1.2, 2.1, 2.2), said cover cap securing the connecting arms (7, 8) of the respective profile connector (1.1, 1.2, 2.1, 2.2) against pivoting.

9. Frame according to claim 1, wherein the profile connectors (1.1, 1.2, 2.1, 2.2) have one respective receiver (16) for a suspension element which may be fixed, in particular, by means of a latching connection.

10. Frame according to claim 1, wherein the connecting arms (7, 8) have one respective receiving groove (17.1, 17.2) for receiving sealing elements, wherein the receiving groove (17.1) of the first connecting arm (7) is open toward a frame exterior in the assembly position and the receiving groove (17.2) of the second connecting arm (8) is closed on the front face by the first connecting arm (7) in the assembly position.

11. Frame according to claim 1, characterised in that the at least one inner profile strip (4) and the at least one outer profile strip (3) of a frame strut are able to be fixed to one another to an insertion depth by means of one of the following means:

an adhesive strip extending over the entire length of the frame strut, T-shaped latching hooks being configured on the upper face thereof for fixing an insect protection net, a double-sided adhesive strip extending over the entire length of the frame strut, a fastening profile strip being fastened thereby to the frame strut for fixing an insect protection net in a clamped manner, an adapter profile strip which may be attached to the inner profile strip (4), the insertion depth being defined by the length thereof, and a clamping strip extending over the entire frame strut, wherein the insect protection net is fixed to the frame strut by means of the clamping strip, a strip which is adhesively bonded to the inner profile strip (4) and which firstly defines the insertion depth and which secondly with its upper face is flush with an adjacent surface of the outer profile strip (3), so that a further element is able to be attached in one plane over the entire length of the frame strut.

12. Frame according to claim 1, wherein at least the inner profile strip (4) and the outer profile strip (3) of the vertical frame struts (1.1, 1.2) have an opening which is continuous along the direction of extent thereof and which faces a frame interior for receiving a pleated fabric.

13. Frame according to claim 1 for insertion in a window opening, consisting of two lateral vertical frame struts (1.1, 1.2) and a lower and an upper horizontal frame strut (2.1, 2.2), wherein the profile connectors (5.1, 5.2, 6.1, 6.2) are configured as corner connectors with in each case just two connecting arms (7, 8) which are pivotable relative to one another.

14. Frame according to claim 1 for a door opening, consisting of four lateral vertical frame struts (1.1, 1.2) and a lower, a central and an upper horizontal frame strut (2.1, 2.2), wherein the central frame strut is connected in each case at both ends to two vertical frame struts (1.1, 1.2) by means of a profile connector which is configured as a central connector, wherein the central connector has in each case three connecting arms which are pivotable relative to one another.

15. An insect protection device comprising a frame according to claim 1 and an insect protection net which is fastened in or on the frame.

* * * * *